United States Patent [19]

Ripka et al.

[11] Patent Number: 4,570,612

[45] Date of Patent: Feb. 18, 1986

[54] INDUCED DRAFT SUBMERGED BURNER

[75] Inventors: Chester D. Ripka, East Syracuse; James N. Friedman, Manlius; Thomas E. Drago, Liverpool, all of N.Y.

[73] Assignee: Carrier Corporation, Syracuse, N.Y.

[21] Appl. No.: 672,548

[22] Filed: Nov. 19, 1984

[51] Int. Cl.[4] ..... F24H 1/20

[52] U.S. Cl. ..... 126/360 A; 122/31 A

[58] Field of Search ..... 122/31 A; 126/360 A

[56] References Cited

U.S. PATENT DOCUMENTS

| | | | |
|---|---|---|---|
| 971,724 | 10/1910 | Brunler | 126/360 A X |
| 987,160 | 3/1911 | Hoyes | 126/360 A X |
| 3,194,229 | 7/1965 | Borgeson | 126/360 A |
| 4,069,807 | 1/1978 | Hartig | 126/360 A X |

FOREIGN PATENT DOCUMENTS

| | | | |
|---|---|---|---|
| 551533 | 7/1923 | France | 122/31 A |

*Primary Examiner*—Edward G. Favors

*Attorney, Agent, or Firm*—Robert H. Kelly

[57] ABSTRACT

A method and apparatus for recovering heat from the combustion gas discharged from a submerged horizontal burner. The burner is at atmospheric pressure while an induction fan reduces the pressure inside the heat exchanger and draws the ignited combustion gas through a submerged combustion chamber and through the liquid to a flue. The liquid flows in counterflow arrangement with the combustion gas which further enhances the heat transfer between the combustion gas and the liquid.

13 Claims, 4 Drawing Figures

INDUCED DRAFT SUBMERGED BURNER

BACKGROUND OF THE INVENTION

This invention relates generally to direct contact gas-to-liquid heat exchanger systems and, more particularly, to an induced draft, submerged, horizontal combustion burner water heater and a method of recovering heat from the combustion gas discharged from a submerged burner.

Althouth the present invention can be used in association with a wide range of gas-to-liquid heating devices, it is particularly well suited for use in conjunction with heating domestic hot water. The prior art direct contact gas-to-liquid heating devices were generally vertical burner sumberged combustion devices. These sumberged combustion devices had the combustion source within a can, and the can was submerged in water, Generally, the can was perforated with holes near the bottom to allow flue gas from the burned fuel in the combustion chamber to bubble up through the liquid medium, thereby giving up a portion of its heat to the liquid. However, with the prior art vertical burners there is a tendency for the liquid to sump back through the burner can and flood the burner when the heater is shut off. This is especially true when the heater is required to periodically cycle on and off, such as in domestic hot water heating systems.

In prior art vertical burner submerged combustion systems the burner unit is generally used in conjunction with pressurized air which displaces the water out of the perforated can and into the water tank. The available heat in the flue gas is transferred from the flue gas bubbles directly to the water in the tank. The flue gas bubbles are then exhausted at the top of the water tank while the heated water flows out the water outlet.

SUMMARY OF THE INVENTION

This invention is directed to a horizontal burner, induced draft, submerged combustion system and a method of operating the system to prevent flooding the burner.

In a preferred embodiment, an induced draft fan, located at the top of the water tank, furnishes a vacuum for the system. The induced draft fan draws combustion air from outside the tank through the horizontal burner which has a "U" tube terminating in a submerged combustion exhaust chamber. Generally, when the burner is off the water tank is filled to the bottom of the "U" bend portion of the combustion chamber by controlling the flow of liquid into and out of the tank. The "U" bend prevents water from flowing back to the burner unit. After filling the tank to the bottom of the "U" bend the induced draft fan is started and the air drawn into the combustion chamber displaces water out of the exhaust portion of the combustion chamber. After the burner is ignited to start the submerged combustion process the vacuum pressure may be increased or the liquid flow through the tank varied, to allow the entire "U" bend to be submerged in water. The entire combustion chamber is generally submerged under water to increase the heat transfer from the combustion chamber to the liquid.

The hot combustion gases flow through the apertures in the combustion chamber into the water and are drawn out through the induced draft fan to a flue pipe, transferring heat directly to the water. As a result, the gases are rapidly cooled to the temperature of the heated water. In an ideal direct contact heater, the temperature of the combustion gases leaving the tank would be the same as the temperature of the water in the tank.

To enhance the heat transfer between the flue gas and the water, the present invention also provides an enclosure within the water tank into which the inlet water and combustion gases are introduced. Since the inlet water temperature is lower than the tank temperature, the exiting flue gas temperatures can approach the water temperature in the enclosure, which is also lower than the water temperature in the tank, thus further increasing the thermal efficiency of the system.

Accordingly, it is an object of the present invention to increase the thermal efficiency of a domestic hot water heating system.

It is another object of the present invention to reduce the air pressures necessary for submerged combustion.

It is a further object of the present invention to prevent fluid from sumping back into the burner during the non-operational mode.

It is still another object of the present invention to inject the inlet water and combustion gases directly into an enclosure within the water tank whereby the inlet water does not interact directly with the tank water.

These and other objects of the present invention are attained by an induced draft, submerged, horizontal combustion burner water heater comprising a heat recovery heat exchanger defining a combustion gas flow path and circulating water flow path for conducting water from a source thereof, through said circulating water flow path in heat transfer relationship with combustion gas in said combustion gas flow path, and out an outlet and for maintaining the combustion gas in said combustion gas flow path in direct communication with the water; a combustion chamber located within said combustion gas flow path for drawing combustion gas from the burner, said combustion chamber including an inverted U-shaped section located above the level of the water when the burner is non-operating for maintaining the combustion gas in said combustion gas flow path separate from said water, and a generally vertical combustion exhaust chamber section for discharging the combustion gas directly in contact with the water in said combustion gas flow path; a cold water inlet for injecting water at the beginning of said circulating water flow path; a hot water outlet for discharging water at the end of said circulating water flow path; and an induction fan means disposed near the top of said heat recovery heat exchanger and located within said combustion gas flow path for discharging combustion gas from said heat recovery heat exchanger. The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
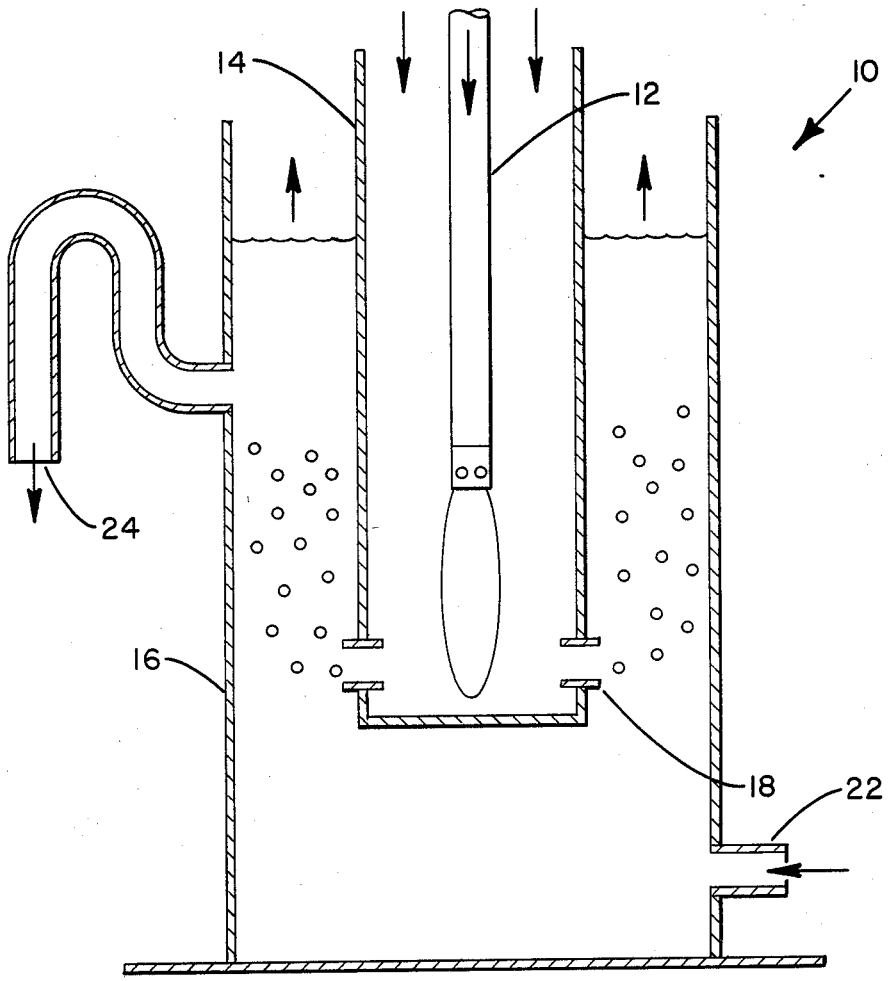
FIG. 1 PRIOR ART
FIG. 1 is a side elevation of a schematic view of a prior art vertical burner, submerged combustion system.

FIG. 1 illustrates a vertical burner, submerged combustion system 10 of the prior art. In this system a burner 12 is mounted vertically in a combustion chamber 14 which, in turn, is immersed in a water tank 16. The combustion chamber 14 has a plurality of holes 18 located near the bottom the allow flue gas bubbles 19 to be dispersed within the tank water. The combustion air is forced through the system, at a positive pressure, by means of a blower (not shown). The liquid to be heated flows through inlet 22 into the tank 16 where it is heated by direct contact with the combustion gases and then flows through outlet 24.

In direct contact heaters, it is desirable to introduce the hot gases into the liquid at the lowest possible level to provide a longer path for the bubbles to travel and hence more efficiently transfer the heat from the combustion gas to the liquid. Accordingly, in the prior art, as shown in FIG. 1, the combustion gases flow through the apertures near the bottom of the combustion chamber into the surrounding tank and bubble upwardly through the liquid while the cooler liquid also enters near the bottom and flows upward after it is heated. However, there is a tendency for the liquid to sump back through the combustion chamber and drown the burner when the heater is shut off.

Figure 2:
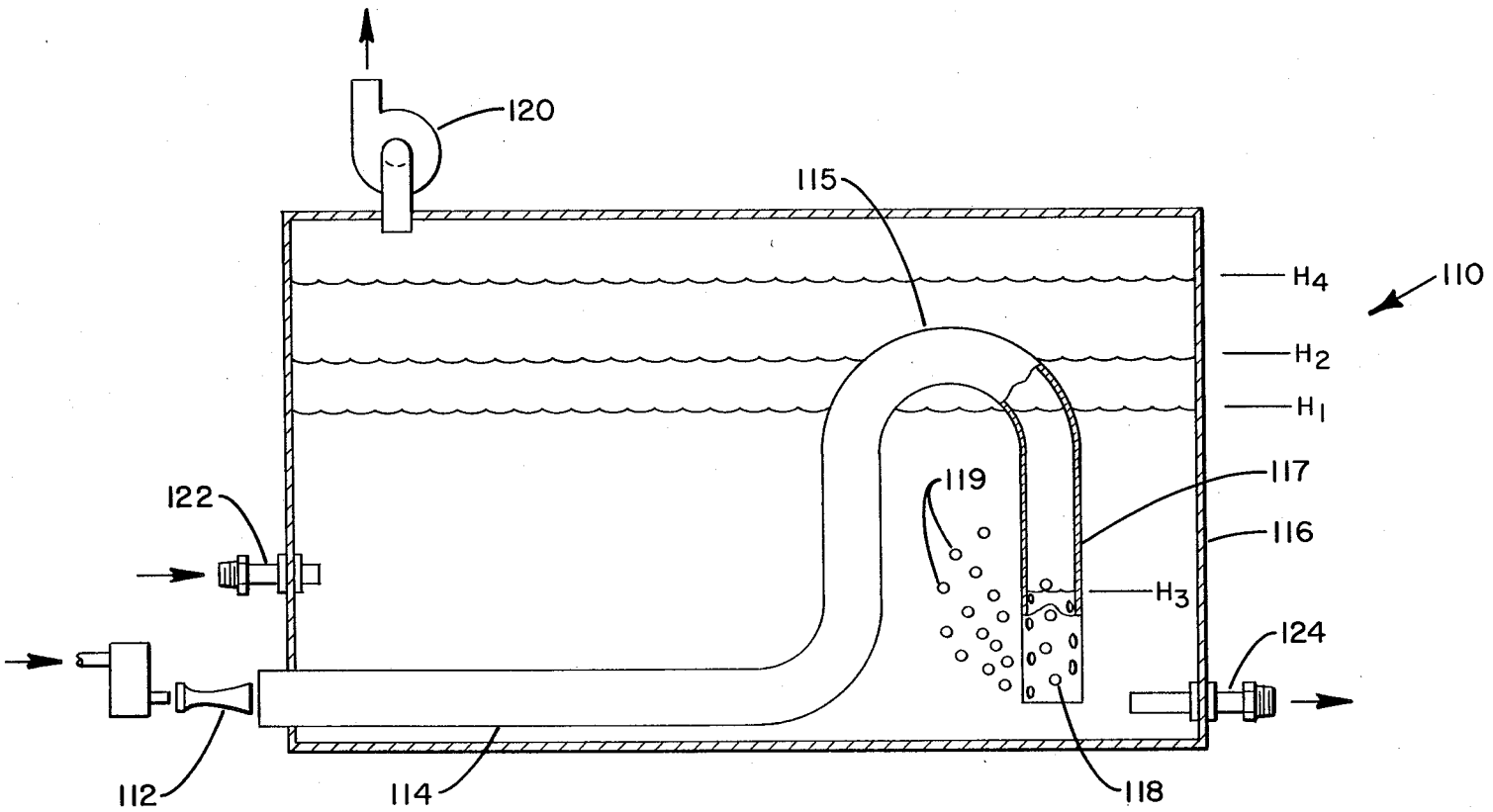
FIG. 2 is a side elevation schematic view of a direct-fired, horizontal burner, induced draft submerged combustion water heater of the present invention.

As shown in FIG. 2, the water heater 110 of an embodiment of the present invention has a horizontal burner 112 which supplies combustion gas to the combustion chamber 114. The combustion chamber 114 has a U-shaped portion 115 terminating in a combustion exhaust chamber 117. The combustion exhaust chamber 117 has a plurality of randomly distributed apertures 118 therethrough to allow flue gas to bubble therethrough. The combustion gases from the burner 112 are ignited and drawn through the combustion chamber 114 by the induced draft fan 120. These combustion gases exit the apertures 118 in the combustion exhaust chamber 117 as bubbles 119. The induced draft fan 120 creates a vacuum pressure within the hot water tank 116 which allows the inlet combustion air to displace water out of the combustion exhaust chamber 117.

To prevent liquid from flowing back to the burner 112, the water tank 116, which generally encloses the combustion chamber, is initially filled to the bottom of the U-shaped bend portion of the combustion chamber 114. After the tank 116 is filled to its appropriate level, and the induced draft fan 120 draws a vacuum pressure within the tank, the gas burner 114 is ignited and the submerged combustion process proceeds.

To operate the water heater of the embodiment illustrated in FIG. 2, the water tank 116 is filled to the bottom of the U-shaped bend of the combustion chamber, generally to a level indicated by $H_1$. After the induced draft fan is started, a vacuum pressure within the tank raises the liquid level to $H_2$ in the tank while the liquid downstream of the U-shaped bend is lowered to $H_3$. The liquid level downstream of the U-shaped bend is lowered sufficiently to allow the bubbles 119 to flow from the aperture 118. Finally, when the gas burner 112 is ignited the vacuum pressure in the tank is generally increased or the flow of water into the tank is increased to allow the entire U-shaped bend to be submerged in the water. The water rises to a level indicated by $H_4$ to prevent radiation heat transfer losses from the unsubmerged U-shaped bend.

When the heater is ignited liquid flows into the tank through inlet 122 and hotter liquid exits through outlet 124 to an external heat disbribution system (not shown). Further, a tank overflow system may be necessary to remove excess water formed by the combustion process from the tank.

Figure 3:
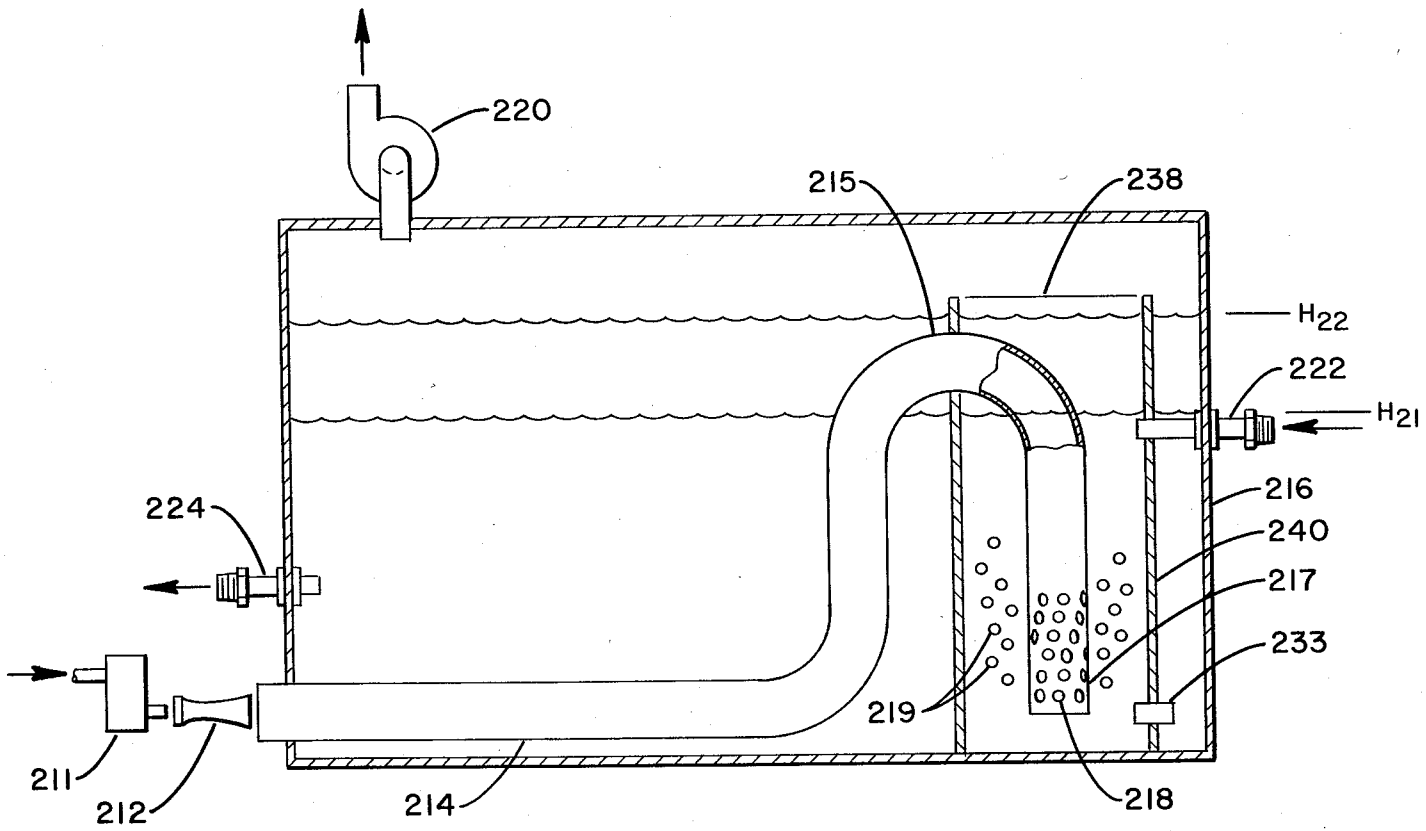
FIG. 3 is a side elevation of a schematic view of another embodiment of a horizontal burner, induced draft submerged combustion water heater of the present invention.
Figure 4:
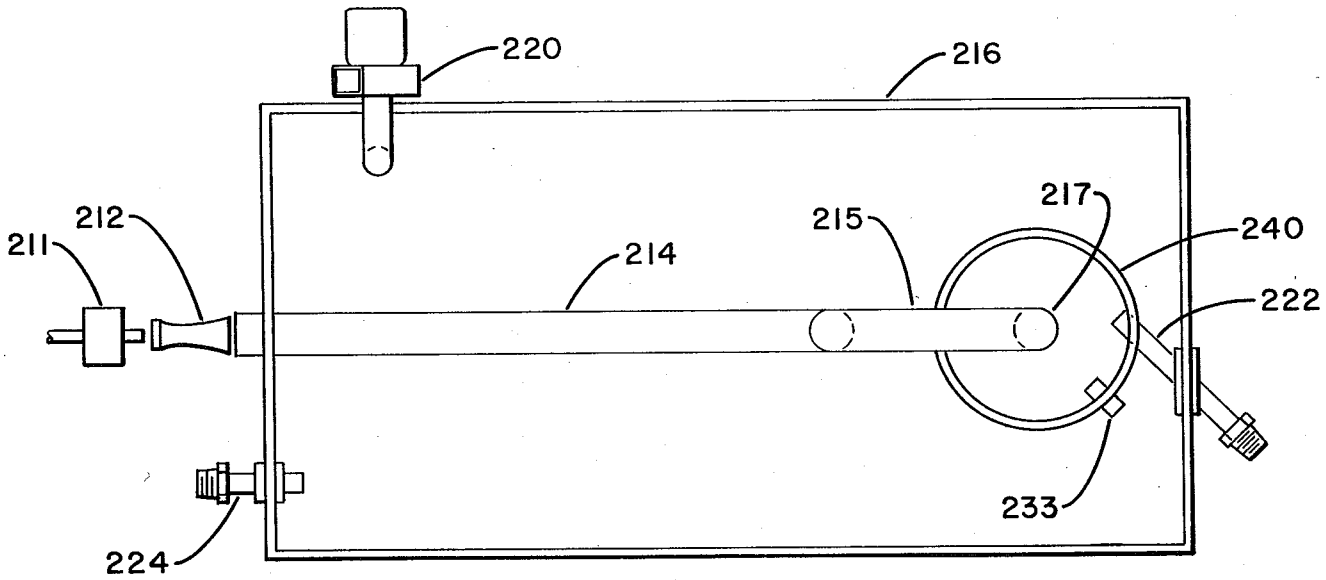
FIG. 4 is a top plan view of the hot water heater of FIG. 3.

In another embodiment, illustrated in FIGS. 3 and 4, the combustion exhaust chamber 217 is located within an enclosure 240, within water tank 216. The enclosure 240 is used to increase the thermal efficiency of the heater. In this embodiment the inlet 222 allows the injection of cold liquid directly into the enclosure 240. This inlet liquid is at a lower temperature than the liquid within both the enclosure 240 and tank 216. Thus, the exiting flue gas temperature approaches the inlet liquid temperature and the temperature of the liquid flowing from the enclosure is generally higher than the temperature of the liquid in the tank, since the heat transferred from the combustion gases generally occurs within the smaller enclosure. In this embodiment, small diameter diagonal distribution holes 218 are contained in the combustion exhaust chamber 217 to promote better heat transfer between the flue gas and the tank fluid. The diameter of the holes may vary along the longitudinal axis, with the downstream holes being slightly larger, (e.g. $\frac{1}{8}$ inch) and the upstream holes (e.g. 3/32 inch). With the deliberate hole arrangement the flue gas bubbles do not interfere with each other due to the diagonal distribution of the holes along the exhaust chamber.

Further, the inlet 222 is generally located near the top of the enclosure 240 while the connection conduit 233, which allows heated liquid from the enclosure 240 to flow into the tank 216, is located near the bottom of the enclosure 240. This arrangement creates a counterflow heat exchange relationship, since the combustion exhaust chamber 217, which exhausts hot combustion gases, is in close promimity with the connection conduit 233, which transfers the hottest fluid contained in the enclosure 240 to the tank 216, while the coolest flue gas exits the enclosure 240 through the open top 238 which is in close proximity with the inlet 222. Also, the inlet 222 generally enters the enclosure 240 in a tangential relationship thereto. This tangential inlet 222 creates a high degree of swirl within the enclosure 240 and further enhances the heat transfer between the combustion gas and the liquid. Moreover, the embodiment shown in FIGS. 3 and 4 permits the exiting flue gas temperature at the induced draft fan 220 to be reduced below the temperature of the liquid exiting the tank 216 through outlet 224.

When the embodiment of FIG. 3 is used to heat a liquid, operation of the heater is as follows. The liquid level is brought to the bottom of the U-shaped bend 215 by injecting water into enclosure 240 through inlet 222 to the level $H_{21}$. The level is maintained at the bottom of the U-shaped bend by level control system well known in the art which may include a liquid level switch and a control valve for controlling fluid flow through inlet 222. The draft from induced draft blower 220 draws room air into combustion chamber 214 through the vertical U-shaped bend 215 and out the holes 218 in the combustion exhaust chamber 217. The air mixes with fuel from fuel supply 211, which is ignited and produces a flame at burner 212. The hot exhaust gas from the combustion process in the combustion chamber 214 bubbles out the holes 218 in the combustion exhaust chamber 217. The induced draft fan 220 creates a vacuum pressure within tank 216 which raises the liquid level in the tank 216 and the enclosure 240 to the level $H_{22}$, which covers the U-shaped bend 215 with the liquid. As the bubbles 219 rise through the liquid medium they give up their heat so that when they reach the induction fan they approach the same temperature as the liquid flowing through inlet 222 into the enclosure 240. The combustion gases are then discharged to a flue pipe (not shown). The heated liquid in the enclosure then flows through connection conduit 233 into the larger tank 216, and heats the liquid in the tank. This embodiment of the invention further enhances the thermal efficiency of the submerged burner.

Of course, the foregoing description is directed to only two embodiments of the present invention and various modifications and other embodiments will be readily apparent to one of ordinary skill in the art to which the present invention pertains.

What is claimed is:

1. A heat exchange apparatus for raising the temperature of a liquid contained in a tank comprising:

a horizontal fuel burner located externally to the tank for igniting a fuel and providing combustion gases to the tank;

a combustion chamber generally disposed within the tank for directing said combustion gases therethrough, said combustion chamber including a generally horizontal combustion portion having an inlet in communication with said burner, a generally vertical combustion exhaust portion for discharging the combustion gases into the liquid in the tank, said horizontal combustion portion and said vertical combustion exhaust portion submerged in the liquid, and a generally inverted U-shaped portion connecting said horizontal portion to said combustion exhaust portion, the curved part of said inverted U-shaped portion being above the liquid in the tank during non-operation of the heat exchange apparatus;

a cold liquuid inlet connected to the tank for injecting the liquid in heat exchange relationship with said combustion gases;

a hot liquid outlet for passing the liquid out from the tank, said hot liquid outlet located in close proximity to said combustion exhaust portion of said combustion chamber; and a vaccum pump disposed near the top of the tank to provide a negative pressure in the tank and through which the combustion gases, after exchanging heat directly with the injected cold liquid, pass on their way to be discharged from the tank, said cold liquid inlet located in close proximity to said vacuum pump whereby said combustion gases are in counterflow relationship with said liquid.

2. A heat exchange apparatus as recited in claim 1 wherein a plurality of apertures are disposed about the perimeter of said combustion exhaust portion of said combustion chamber.

3. A heat exchange apparatus as recited in claim 2 wherein said apertures are longitudinally spaced at diagonal intervals along the length of said combustion exhaust portion of said combustion chamber.

4. A heat exchange apparatus as recited in claim 1 and further comprising:

an enclosure means disposed within the tank to separate the liquid in the tank from the interior of said enclosure means and positioned to circumscribe said combustion exhaust portion of said combustion chamber whereby the flow of combustion gases from said combustion exhaust portion circulate only in said enclosure means and are discharged by said vacuum pump without directly contacting the liquid in the tank, and whereby said cold liquid inlet injects the liquid directly into said enclosure means; and a liquid connecting means in the wall of said enclosure means for communicating fluid between the interior of said enclosure means and the tank.

5. A heat exchange apparatus as recited in claim 4 wherein a plurality of apertures are disposed about the perimeter of said combustion exhaust portion of said combustion chamber.

6. A heat exchange apparatus as recited in claim 5 wherein said apertures are longitudinally spaced at diagonal intervals along the length of said combustion exhaust portion of said combustion chamber.

7. A heat exchange apparatus as recited in claim 4, wherein said liquid connecting means is located in closer proximity to said combustion exhaust portion of said combustion chamber, and said cold liquid inlet is located in closer proximity to said vacuum pump whereby said combustion gases are in counterflow relationship with said liquid flowing through said enclosure means.

8. A heat exchange apparatus as recited in claim 7 wherein said cold liquid inlet is disposed tangential to said enclosure means whereby a high degree of swirl of the liquid is created within said enclosure means.

9. An induced draft, submerged, horizontal combustion burner water heater comprising:

a heat recovery heat exchanger defining a combustion gas flow path for combustion gas and a circulating water flow path for circulating water, said circulating water in said circulating water flow path in direct heat transfer relationship with said combustion gas in said combustion gas flow path;

a combustion chamber located within said combustion gas flow path for drawing combustion gas from the burner, said combustion chamber including an inverted U-shaped section located above the level of the water when the burner is not operating for maintaining the combustion gas in said combustion gas flow path separate from said circulating water, and a generally vertical combustion exhaust chamber section for discharging the combustion gas directly in contact with the circulating water;

an enclosure means circumscribing said combustion exhaust chamber section;

a cold water inlet for injecting water directly into said enclosure means at the beginning of said circulating water flow path;

a hot water outlet for discharging water at the end of said circulating water flow path;

a liquid passageway passing through said enclosure means and located within said circulating water flow path for conducting water from within said enclosure means to said hot water outlet; and an induction fan means disposed near the top of said heat recovery heat exchanger and located within said combustion gas flow path for discharging combustion gas from said heat recovery heat exchanger.

10. A water heater as recited in claim 9 wherein a plurality of apertures are longitudinally spaced at diagonal intervals along the length of said combustion exhaust chamber section.

11. A water heater as recited in claim 10 wherein said cold water inlet is disposed tangential to said enclosure means.

12. A water heater as recited in claim 11 wherein said liquid passageway is located in close proximity to said combustion exhaust chamber section and said cold water inlet is located near the top of said enclosure means whereby said combustion gas flow path is in counterflow relationship with said circulating water flow path.

13. A method of recovering heat from a sumberged, horizontal combustion burner of a heat exchanger comprising the steps of:

passing the combustion gas discharged from the combustion burner through a combustion chamber in heat exchange relationship with water to heat the water, said combustion chamber having a combustion portion, an inverted U-shaped portion, and an exhaust portion;

maintaining the water level below the curved portion of said inverted U-shaped portion during non-operation of the burner;

conducting water through the heat exchanger, said water being first injected into an enclosure within the heat exchanger, said enclosure simultaneously receiving the combustion gas discharged from said combustion chamber, and said water next being passed from the enclosure to the heat exchanger; and maintaining a vacuum pressure in the heat exchanger when the combustion gas in passing in heat exchange relationship with the water.

* * * * *